US005485146A

United States Patent [19]

Umetsu et al.

[11] Patent Number: 5,485,146

[45] Date of Patent: Jan. 16, 1996

[54] PAGING RECEIVER

[75] Inventors: Shinjiro Umetsu; Yasuhiro Kobayashi, both of Tokyo, Japan

[73] Assignee: NEC Corporation, Tokyo, Japan

[21] Appl. No.: 455,254

[22] Filed: May 31, 1995

Related U.S. Application Data

[63] Continuation of Ser. No. 64,671, May 21, 1993, abandoned, which is a continuation of Ser. No. 708,311, May 31, 1991, abandoned.

[30] Foreign Application Priority Data

May 31, 1990 [JP] Japan ..... 2-139815

[51] Int. Cl.[6] ..... G08B 5/22

[52] U.S. Cl. ..... 340/825.44; 340/825.22

[58] Field of Search ..... 340/825.44, 825.48, 340/825.22, 311.1; 235/382.5; 365/94, 103, 104

[56] References Cited

U.S. PATENT DOCUMENTS

| | | | |
|---|---|---|---|
| 4,422,071 | 12/1983 | de Graaf | 340/825.44 |
| 4,593,155 | 6/1986 | Hawkins | 340/825.44 X |
| 4,839,628 | 6/1989 | Davis et al. | 340/311.1 |
| 4,910,510 | 3/1990 | Davis et al. | 340/825.44 |
| 5,012,234 | 4/1991 | Dulaney et al. | 340/825.44 |
| 5,049,874 | 9/1991 | Ishida et al. | 340/825.44 |

FOREIGN PATENT DOCUMENTS 1936588 12/1988 Australia .

*Primary Examiner*—Donald J. Yusko
*Assistant Examiner*—Edwin C. Holloway, III
*Attorney, Agent, or Firm*—Sughrue, Mion, Zinn, Macpeak & Seas

[57] ABSTRACT

A paging receiver capable of writing a paging code in an ID ROM according to a received signal. When no data is present in the ID ROM, an ID ROM checking section generates a no-data signal. A mode set code detecting section generates a detection signal when received a predetermined mode set code. A switch is turned on and off by the user of the paging receiver. The receiver allows data to be written to the ID according to a received data on condition that the switch is turned on with the no-data signal and detection signal being generated.

8 Claims, 3 Drawing Sheets

PAGING RECEIVER

This is a Continuation of application No. 08/064,671 filed May 21, 1993 now abandoned, which is a continuation of 07/708,311, filed May 31, 1991, now abandoned.

BACKGROUND OF THE INVENTION

The present invention relates to a paging receiver and, more particularly, to a paging receiver which allows a paging code to be written to an ID (identification) ROM thereof according to a received signal.

A paging receiver usually has an ID ROM for writing and storing a paging code assignd to the receiver. It is well known in the art to use, as an ID ROM, any of a variety of non-volatile, programmable memory devices. It has been customary with a paging receiver to write a paging code in an ID ROM with a ROM writer and then mount it on the receiver or to mount an ID ROM in the receiver beforehand and then write a paging code in the ID ROM by connecting a ROM writer to a write terminal provided in the receiver. However, connecting a ROM writer to an ID ROM or to a paging receiver with an ID ROM and then writing a paging code in the ID ROM is troublesome.

SUMMARY OF THE INVENTION

It is therefore an object of the present invention to provide a paging receiver which allows a paging code to be written to an ID ROM according to a received signal when particular conditions are satisfied.

It is another object of the present invention to provide a paging receiver which promotes accurate writing of a paging code in an ID ROM.

It is another object of the present invention to provide a paging receiver which allows a paging code to be written to an ID ROM without resorting to a ROM writer.

It is another object of the present invention to provide a generally improved paging receiver.

A paging receiver of the present invention allows data to be written to an ID ROM thereof according to a received signal only on condition that no data is present in the ID ROM.

Also, a paging receiver capable of writing a paging code in an ID ROM thereof according to a received signal of the present invention comprises an ID ROM checking section for generating a no-data signal when no data is present in the ID ROM, a mode set code detecting section for generating a detection signal when received a predetermined mode set code, and a commanding section for generating a write command signal to command writing of a paging code in the ID ROM. A paging code is written to the ID ROM according to a received signal only when all of the no-data signal, detection signal and write command signal are generated.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1A:
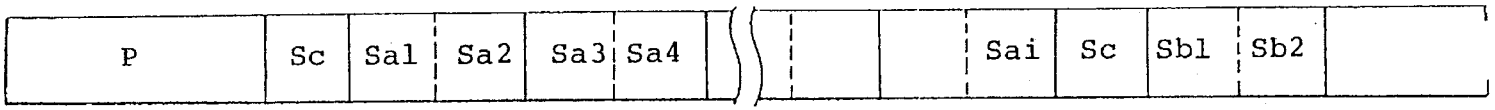
FIGS. 1A–1D show a specific format of a signal which a paging receiver embodying the present invention receives.
Figure 1B:
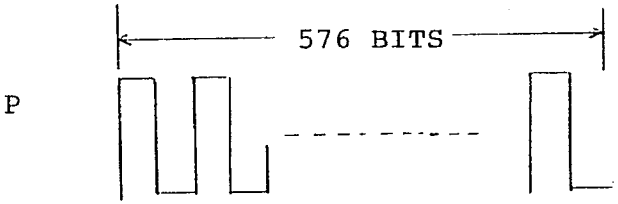
Figure 1C:
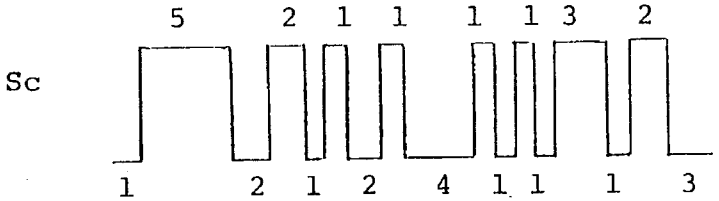
Figure 1D:
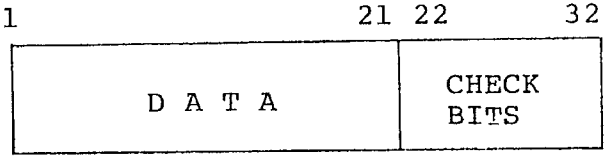

Referring to FIG. 1A of the drawings, a specific format of a signal which a paging receiver embodying the present invention receives is shown. As shown, the signal is implemented as a POCSAG (Post Office Code Standardization Advisory Group) signal made up of a preamble signal P for activating a receiving function, frame synchronizing signals Sc, and paging codes $Sa_1, Sa_2, \ldots, Sa_i, Sb_1, Sb_2, \ldots, Sb_i, \ldots, Sx_1, Sx_2, \ldots, Sx_i$. FIG. 1B plots the waveform of the preamble signal P while FIG. 1C plots the waveform of the frame synchronizing signals Sc. As shown in FIG. 1D, the paging codes $Sx_i$ each is constituted by data and check bits.

Figure 2:
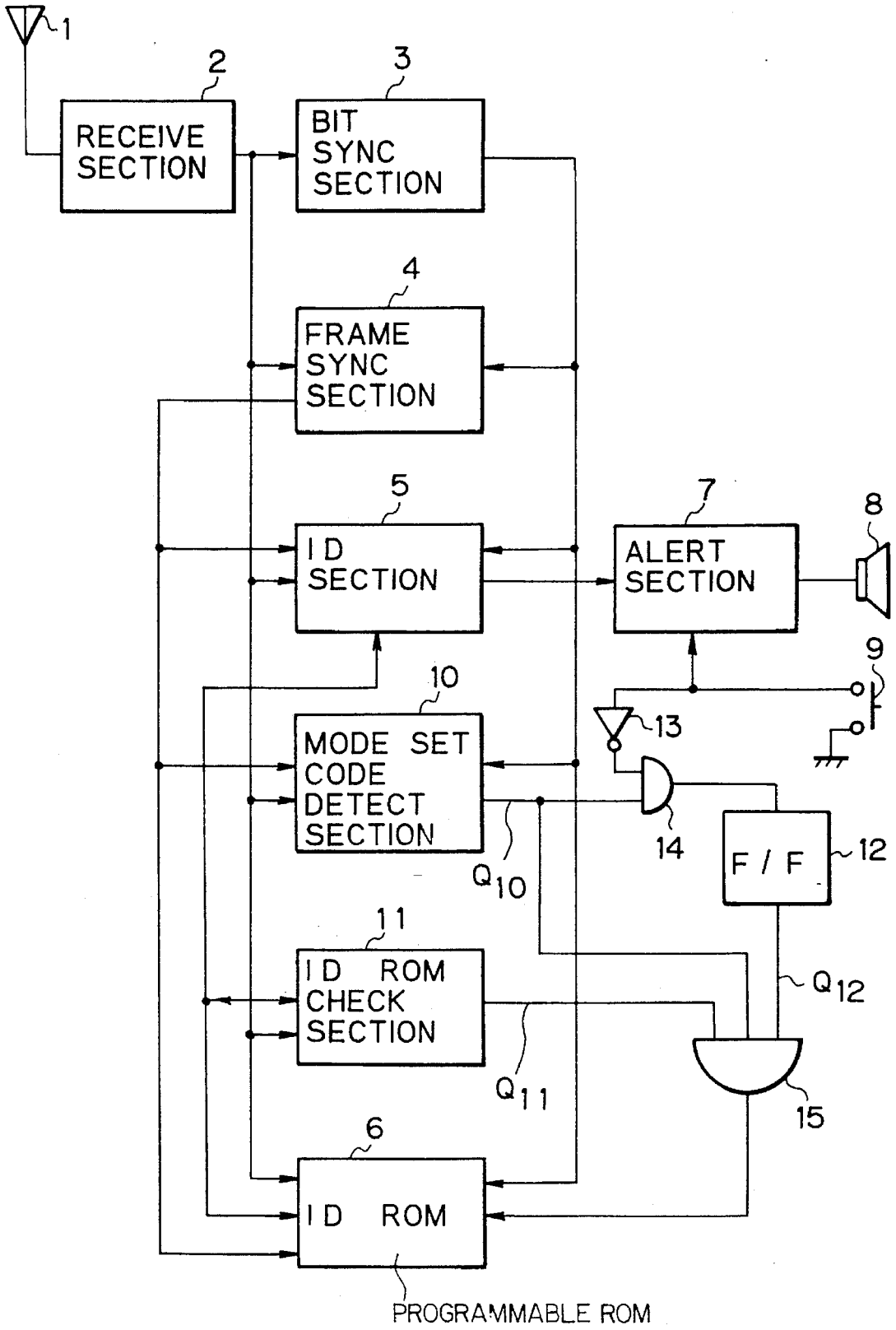
FIG. 2 is a block diagram schematically showing the illustrative embodiment.

The illustrative embodiment will be described with reference to FIG. 2. In FIG. 2, the paging receiver has an antenna 1 through which a signal having the format shown in FIGS. 1A–1D specifically comes in. The resultant electric signal induced in the antenna 1 is decoded by a receiving section 2 and then transferred to various sections which will be described. A bit synchronizing section 3 sets up synchronization to the rate of the received signal on the basis of the preamble signal P and feeds a read clock to the various blocks. A frame synchronizing section 4 detects the symbols of the frame synchronizing signals Sc to give the various blocks the word-by-word read timings for reading the paging codes $Sa_i, Sb_i, \ldots, Sx_i$ which follow the signals Sc. An identifying (ID) section 5 compares a paging code included in the received signal with a paging code stored in an ID ROM 6 beforehand and, if the former is coincident with the latter, drives an alerting section 7. In response, the alerting section alerts the user of the receiver to the call via a loudspeaker 8. A switch 9 is connected to ground at one contact thereof and turned on and off by the user. When the switch 9 is turned on, it causes the alerting section 7 to stop operating. A mode set code detecting section 10 has an output $Q_{10}$ which is usually held in a low level. While any of the paging codes $Sa_i, Sb_i, \ldots, Sx_i$ is received, the output $Q_{10}$ of this section 10 changes to a high level on detecting a predetermined mode set code. An ID ROM checking section 11 checks the ID ROM 6 to see if any data is stored therein. The output $Q_{11}$ of the ID ROM checking section 11 is in a high level only when no data is stored in the ID ROM 6.

The ID ROM 6, ID section 5 and mode set code detecting section 10 each reads or can read the received signal at a paging code read timing while being clocked by the read clock.

When the switch 9 is turned on, a high-level signal is fed to one input terminal of an AND gate 14 via an inverter 13. The output terminal $Q_{10}$ of the mode set code detecting section 10 is connected to the other input terminal of the AND gate 14. The output terminal of the AND gate 14 is connected to a flip-flop 12. An AND gate 15 has three input terminals to which the output terminal $Q_{12}$ of the flip-flop 12, the output terminal $Q_{10}$ of the mode set code detecting section 10 and the output terminal $Q_{11}$ of the ROM checking section 11 are connected. The output terminal of the AND gate 15 is in turn connected to the ID ROM 6. When the output of the AND gate 15 is in a high level, it holds the ID ROM 6 in a ready-to-write condition.

Figure 3:
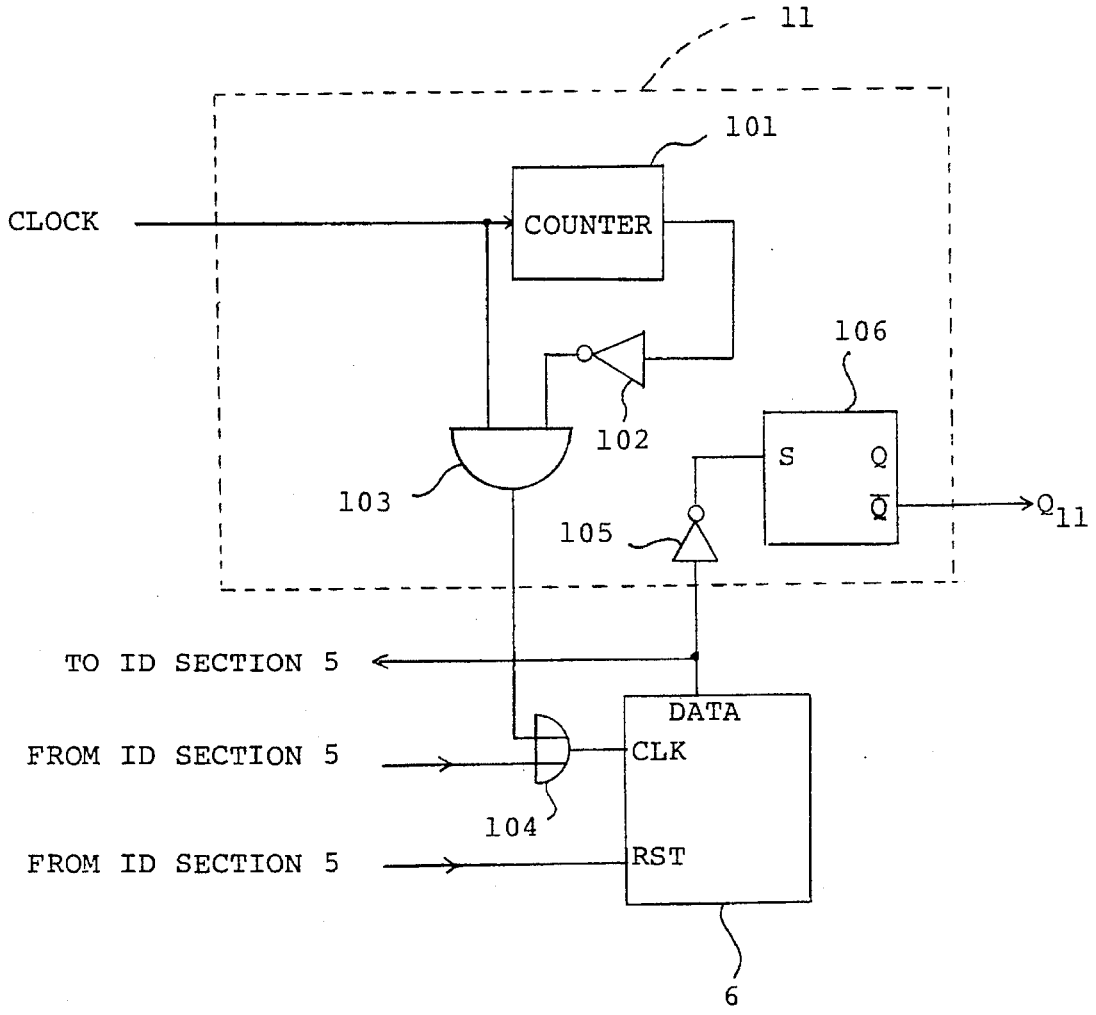
FIG. 3 is a block diagram schematically showing a specific arrangement of an ID ROM and an ID ROM checking section included in the embodiment.

FIG. 3 shows a more specific construction of the ID ROM 6 and ID ROM checking section 11. As shown, the ID ROM 6 has input terminals RST and CLK and an output terminal DATA. When a pulse is fed from the ID section 5 to the input terminal RST, the ID ROM 6 outputs the content of the address 0 via the output terminal DATA. Every time the ID section 5 feeds a pulse to the input terminal CLK via a NOR gate 104, the address of the ID ROM 6 is updated such as from the address η to the address η+1. As a result, the contents of the ID ROM 6 are sequentially read out via the output terminal DATA. The ID ROM checking section 11 has a counter 101 which is to be initialized on the turn-on of the power source of the paging receiver. As soon as the counter 101 counts a predetermined number of clock pulses, the output thereof changes from a low level to a high level. That is, the counter 101 is a presettable counter. The output terminal of the counter 101 is connected to an AND gate 103 via an inverter 102. Therefore, the AND gate 103 remains open until the counter 101 counts the predetermined number of clock pulses after it has been initialized. The predetermined number of clock pulses mentioned above may be the same as the number of addresses of the ID ROM 6, e.g. 512 bits. Then, after the counter 101 has been initialized, clock pulses identical in number with the addresses of the ID ROM 6 will be fed to the ID ROM 6 via the NOR gate 104 to output data stored in all of the addresses of the ROM 6 via the output terminal DATA. The data from the ID ROM 6 are applied to the terminal S of an SR flip-flop 106 via an inverter 105. The addresses of the ID ROM 6 where data is absent are outputted as a high level, while the addresses where data is present are outputted as either one of a low level and a high level depending on the data. Generally, an ID ROM storing data therein maintains at least one bit thereof in a low level. Hence, when no data is stored in the ID ROM 6, the input to the terminal S of the SR flip-flop 106 is in a low level with all of the addresses of the ID ROM 6, so that the output terminal $\overline{Q}$ of the flip-flop 106 remains in a high level. On the other hand, when data is stored in the ID ROM 6, the input to the input terminal S of the SR flip-flop 106 changes to a high level when a certain address is reached, causing the output terminal $\overline{Q}$ of the flip-flop 106 into a low level. Once a paging code has been written in the ID ROM 6, the absence of any input connection to the reset terminal of SR flip-flop 106 ensures that $Q_{11}$ will remain at a low level, thereby preventing another paging code from ever being written. In this manner, the output $Q_{11}$ of the ID ROM checking section 11 is in a high level or a low level, depending on whether data is present in the ID ROM 6 or not.

In operation, when a paging code is not written to the ID ROM 16, the output $Q_{11}$ of the ID ROM checking section 11 is in a high level, as stated above. When the mode set code detecting section 10 detects a predetermined mode set code in the paging codes $Sa_i$, $Sb_i$, . . . , $Sx_i$, FIG. 1A, coming in through the antenna 1, the output $Q_{10}$ thereof changes to a high level. The predetermined mode set code may be, for example, "2097152" which will not be used as a paging number. Assume that the switch 9 is turned on by the user while both of the outputs $Q_{10}$ and $Q_{11}$ are in a high level, as stated above. Then, the output of the inverter 13 changes to a high level to bring the output of the AND gate 14 to a high level. As a result, the output $Q_{12}$ of he flip-flop 12 is inverted to a high level. In response to such outputs $Q_{10}$, $Q_{11}$ and $Q_{12}$, the output of the AND gate 15 also changes to a high level to cause the ID ROM 6 into a ready-to-write condition. Thus, a paging code can be written to the ID ROM 6 only when three different conditions are satisfied, i.e., that no data is present in the ID ROM 6, that a mode set code is detected, and that the switch 9 is turned on. Therefore, when data to be written to the IDROM 6 is sent in the form of the paging codes $Sa_i$, $Sb_i$, . . . , $Sx_i$ after the above three conditions have been satisfied, it is written to the ROM 6 according to the received signal.

The arrangement described above allows data to be written to the ID ROM 6 by a simple procedure which does not need a ROM writer.

When a paging code is present in the ID ROM 6, the output $Q_{11}$ of the ID ROM checking section 11 and, therefore, the output of the AND gate 15 is in a low level, inhibiting data from being written to the ID ROM 6. Hence, when the mode set code detecting section 10 erroneously identifies a mode set code, data is prevented from being written to the ID ROM 6.

Further, the ID ROM 6 becomes ready to write data only when the switch 9 is turned on by the user. This allows data to be written to particular ones of a plurality of paging receivers if the mode is set in all of the receivers by a mode set code, then the switches of the particular receivers are turned on, and then data are sent. The paging receivers other than the particular receivers are inhibited from writing data therein.

In summary, in accordance with the present invention, data is written to an ID ROM according to a received signal when switching means is turned on after the detection of a mode set code and while no date is present in the ID ROM. This facilitates the writing of data in a desired ID ROM and prevents data from being written to the other ID ROMs.

Various modifications will become possible for those skilled in the art after receiving the teachings of the present disclosure without departing from the scope thereof.

What is claimed is:

1. A paging receiver which has a function of writing its own paging code only once, comprising:

a programmable ROM for storing a paging code corresponding to said paging receiver;

programmable ROM checking means for generating a no-data signal only when no data is present in said programmable ROM, and a data signal only when data is present in said programmable ROM;

detecting means for generating a detection signal when a predetermined mode set code is detected in a received signal received by said paging receiver;

commanding means for generating a write command signal to command writing of the paging code in said programmable ROM; and means responsive to said no-data signal, said detection signal, and said write command signal for writing into said programmable ROM a paging code indicated by said received signal, said paging code being written to said programmable ROM according to said received signal only when all of said no-data signal, said detection signal and said write command signal are generated;

said programmable ROM checking means generating said no-data signal only until said paging code is written, as said data, into said programmable ROM a first time.

2. A paging receiver as claimed in claim 1, wherein said commanding means comprises switching means for generating an ON signal and an OFF signal, said write command signal comprising said ON signal.

3. A paging receiver as claimed in claim 2, wherein said switching means is operated by hand.

4. The paging receiver as set forth in claim 1, wherein said programmable ROM checking means comprises:

a flip-flop having a set terminal, a reset terminal, an output terminal, an initial state, and a subsequent state;

said no-data signal being generated from said output terminal when said flip-flop is in said initial state;

said set terminal being coupled with said programmable ROM to receive a data output of said programmable ROM;

said data signal being generated from said output terminal when said flip-flop is in said subsequent state; and said reset terminal of said flip-flop being unconnected to prevent a change from said subsequent state to said initial state.

5. The paging receiver as set forth in claim 4, wherein said programmable ROM checking means further comprises:

a counter for providing a preselected number of counter output pulses whenever said paging receiver is turned on; and logic circuit means for logically combining said counter output pulses and a clock pulse to generate a stored data output signal;

wherein said programmable ROM is responsive to said stored data output signal to generate said data output.

6. A paging receiver comprising:

a programmable ROM for storing a paging code corresponding to said paging receiver;

means for receiving a signal to produce a received signal;

means for detecting a condition, when no data is contained in said programmable ROM, to produce a first detect signal; and means responsive to said first detect signal for writing, one time only, into said programmable ROM, paging number data representing said paging code indicated by said received signal, and for preventing writing into said programmable ROM thereafter.

7. A paging receiver as claimed in claim 6, further comprising means for detecting other conditions that a predetermined mode set code is detected in a received signal and that a user of said paging receiver enters a write command in said paging receiver to produce second and third detect signals, respectively, wherein said writing means writes said paging number data into said programmable ROM in response to said first, second and third detect signals.

8. A paging receiver comprising:

programmable ROM means for storing a paging number corresponding to said paging receiver;

first means for detecting a condition when no data is contained in said programmable ROM;

second means for detecting from a received signal a write command to command writing an ID number; and third means connected to said first and second means for writing, one time only, an ID number in said programmable ROM when it is detected by said first means that no data is contained in said programmable ROM and said write command is detected by said second means.

* * * * *